US005418982A

United States Patent [19]

Kishi

[11] Patent Number: 5,418,982

[45] Date of Patent: May 30, 1995

[54] RAW SEWAGE DISPOSAL APPARATUS AND PREFAB FOR ACCOMMODATING THE SAME

[75] Inventor: Mitsuhiro Kishi, Tochigi, Japan

[73] Assignee: Japanic Corporation, Ashikaga, Japan

[21] Appl. No.: 143,522

[22] Filed: Oct. 26, 1993

Related U.S. Application Data

[63] Continuation of Ser. No. 809,962, Dec. 18, 1991, abandoned.

[30] Foreign Application Priority Data

Dec. 21, 1990 [JP] Japan ..... 2-412559
May 28, 1991 [JP] Japan ..... 3-152492

[51] Int. Cl.[6] ..... A47K 11/02
[52] U.S. Cl. ..... 4/111.1; 4/111.5
[58] Field of Search ..... 4/340–342, 4/321–323, 317, 318, 111.1, 111.5, 111.6

[56] References Cited

U.S. PATENT DOCUMENTS

| | | | |
|---|---|---|---|
| 1,303,358 | 5/1919 | Montgomery | 4/321 X |
| 2,279,578 | 4/1942 | Martin | 4/131 |
| 2,432,887 | 12/1947 | Haviland | 210/6 |
| 3,444,051 | 5/1969 | Popma et al. | 202/182 |
| 3,506,543 | 4/1970 | Hayes et al. | 203/10 |
| 3,700,565 | 10/1972 | Cornish et al. | 203/1 |
| 3,922,730 | 12/1975 | Kemper | 4/342 X |
| 3,956,126 | 5/1976 | Streebin et al. | 210/104 |
| 3,995,327 | 12/1976 | Hendrick | 4/317 X |
| 4,196,477 | 4/1980 | Stewart | 4/111.1 |
| 4,222,130 | 9/1980 | Roberts | 4/321 |
| 4,521,304 | 6/1985 | Yount | 210/96.1 |
| 4,999,930 | 3/1991 | Kishi et al. . | |
| 5,043,061 | 8/1991 | Inagaki | 210/151 |
| 5,058,213 | 10/1991 | Kishi et al. . | |
| 5,116,492 | 5/1992 | Zlobin et al. | 210/188 |
| 5,149,399 | 9/1992 | Kishi et al. | 159/22 |
| 5,152,074 | 10/1992 | Kishi | 34/1 |
| 5,230,164 | 7/1993 | Kishi | 34/60 |
| 5,257,466 | 11/1993 | Kishi | 34/95 |
| 5,273,719 | 12/1993 | Kishi et al. | 422/122 |

FOREIGN PATENT DOCUMENTS

| | | | |
|---|---|---|---|
| 0088827 | 3/1990 | Japan | 4/321 |
| WO89/09313 | 10/1989 | WIPO . | |

*Primary Examiner*—Charles E. Phillips
*Attorney, Agent, or Firm*—Flynn, Thiel, Boutell & Tanis

[57] ABSTRACT

A raw sewage disposal apparatus employing a heat-resistant vessel for containing raw sewage, a plurality of stirring blades for stirring the raw sewage in the vessel, a plurality of heat-holding bodies contained in the vessel, an introduction pipe connecting the vessel and a main stool, a closing device provided in the introduction pipe, a urine stool for receiving urine, a urine tank for containing urine, a discharge pipe interposed between the urine tank and the main stool, a valve interposed along the discharge pipe for discharging urine from the urine tank to the main stool, and an air supply for pressurizing the urine tank. The sewage disposal apparatus is preferably mounted in a prefabricated structure having a base, a hollow side wall portion placed on the base, and a roofed portion placed on the side wall portion to cover the interior thereof. A lifting body having a pair of struts are fixedly connected to a side surface of the base and extend to the roofed portion along the side surface of the side wall portion, and a plurality of rungs connect the pair of struts.

11 Claims, 13 Drawing Sheets

RAW SEWAGE DISPOSAL APPARATUS AND PREFAB FOR ACCOMMODATING THE SAME

This application is a continuation of U.S. Ser. No. 07/809,962, filed Dec. 18, 1991, now abandoned.

BACKGROUND OF THE INVENTION

1. Field of the Invention

The present invention relates to a sewage disposal apparatus and a prefabricated structure for accommodating the same. The raw sewage disposal apparatus can be utilized in the outdoors, in a transportation vehicle such as a vessel or train, or in a tunnel through which a tank truck used for collecting raw sewage (hereinafter referred to as a vacuum truck) cannot go and, more particularly to such an apparatus which is capable of cleaning a stool by urine which is temporarily stored in a urine tank. The prefabricated structure can be conveyed by the vacuum truck. The prefabricated structure has a hoist mechanism, which mechanism is utilized to load the prefabricated structure on the bed of the truck from the temporary site or unload the prefabricated structure from the bed of the truck to the temporary site.

2. Description of the Prior Art

The raw sewage discharged from human bodies is typically discharged into a sewage system by use of a flush toilet or the like and then flows into a river after being temporarily stored in a holding tank and purified therein. However, at events such as festivals, athletic events, fairs, meetings and the like, temporary toilet facilities must be provided to dispose of raw human waste.

Employed conventionally are movable temporary toilets, most of which have a tank for temporarily storing the raw sewage therein. However, the temporary toilets have the problem that the raw sewage stored in the tank must be sucked into a vacuum truck for collection, which is laborious and time consuming, for maintenance thereof after use of them, and is unhygienic.

Transportation vehicles, such as busses, trains, vessels, etc., which operate over long distance are provided with a tank exclusively used for storing and holding the discharged raw sewage. The raw sewage in this tank is subjected to a deodorizing treatment by chemicals and thereafter is collected by the vacuum truck.

As mentioned above, the raw sewage in conventional temporary toilets or movable transportation facilities is stored as it is discharged from the human body and is collected thereafter. Accordingly, the storing method, the collection method and the disposal method all are not modern and are very unhygienic.

In an attempt to ameliorate the above problems, there have been proposed several hygienic disposal methods. In one method, for example, chemicals are introduced into the tank where the raw sewage is stored to thereby prevent the bad smell and to effect sterilization of the sewage. This method, however, cannot be used for a long period of time because the chemicals become diluted and costs are high.

In another method, the raw sewage is stored in a bag made of vinyl and the like to prevent the diffusion of the bad smell. This method, however, requires a vinyl bag of large size and involves a high cost for disposal thereof, and it is troublesome to separate the raw sewage from the bag.

In still another method, the discharged raw sewage is directly dried by use of heat from a burner, etc. Since the primary component of raw sewage is liquid, a large amount of heat energy is required to remove the liquid and it takes a long time to effect disposal of the raw sewage.

In view of the drawbacks of the conventional methods of disposing of the raw sewage, the present inventor proposed a disposing apparatus having a casing provided with stirring blades and heat holding bodies therein in which the raw sewage is stirred by the rotation of the stirring blades and heated by heat generated by the heat holding bodies whereby the raw sewage is dried in a short period of time as disclosed in Japanese Patent Laid-Open Publication Nos. 63-124150, 63-172852, 63-190857, 63-292789 and Application No. 63-198858, and U.S. Pat. No. 4,999,930. According to the proposed disposal methods, the raw sewage is heated, vaporized in a casing and the liquid component of the raw sewage is vaporized and diffused into the ambient atmosphere. Before the liquid component is diffused, the components which cause a bad smell are resolved by a catalyst so that the vapor is diffused into the atmosphere as an odorless vapor. It was preferable to employ such a method in view of environmental hygiene and preservation even if such method is employed in crowded buildings and/or by throngs of people.

Another related U.S. application is Ser. No. 575,910, filed Aug. 29, 1990.

It is hygienic to evaporate and dry the raw sewage contained in the airtight tank and such operations can be carried out systematically, which results in not causing a burden to the operators. However, the conventional raw sewage disposal apparatus includes a stool which is connected thereto and filth is liable to attach to the stool after long term use of the stool, which makes the temporary toilet unsightly. Under the circumstance, it is preferable to clean the stool every time the user uses the stool. Conventionally, the water stored in the stool is jetted so that the filth attached to the stool is forcibly removed. The water which was used for cleaning the stool is evaporated together with the raw sewage. With such an arrangement, an exclusive water tank should be provided in the raw sewage disposal apparatus, which makes the structure of the temporary toilet complex and makes the maintenance of the water tank troublesome because the water should be supplied regularly into the water tank.

To meet the demand, the present inventor proposed a recycling type disposal apparatus which is disclosed in Japanese Patent Application No. 2-164594. According to this apparatus, the vapor evaporated in the evaporation cauldron is condensed and stored in another tank. The condensed water is used for flushing. With the arrangement of this apparatus, if a given amount of water is poured, at the early stage of the use, into a water tank, the water cleans the stool and is introduced into the evaporation cauldron and evaporated. The evaporated water is condensed and collected into the water tank, and hence the water can be circulated and used semipermanently. If the exclusive flushing water is used for cleaning the stool, not only the flushing water but also the water for flushing the raw sewage collects in the evaporation cauldron and another is evaporated at the same time, which takes much time for evaporation and much energy is wasted uselessly. In view of the above circumstance, a raw sewage disposal apparatus, which saves the energy and always keeps the stool clean, is desired.

Referring to the prefabricated structure for accommodating the raw sewage disposal apparatus, the conventional temporary house has been installed at temporary sites such as rivers beds, building construction sites, mountains, and used also at offices, lodges, warehouses, etc. Such movable temporary house is assembled and then loaded on the bed of the truck. The temporary house is conveyed by the truck to the temporary site where it is installed. Although the large temporary house having a large capacity and large floor area can not be loaded on the bed of the truck, the temporary house having relatively small floor area is assembled individually and conveyed by the truck and utilized as the temporary toilet. Accordingly, such small temporary house is stored at a warehouse or yard as it is assembled, and is conveyed and used as it is assembled.

Such small temporary house is loaded on the bed of the truck, and conveyed to the temporary site where it is utilized for its purpose. When the temporary house, which is normally kept at the warehouse or yard, is loaded on the bed of the truck, a forklift truck is required. However, the forklift truck is often not available at the temporary site. Accordingly, the temporary house must be unloaded from the bed of the truck by manpower in many cases. Since such temporary toilet is often provided with a cooler, a luminaire, a locker, etc., it is difficult to manually load it on or unload it from the bed of the truck. Thus, the forklift truck should be moved to the temporary site, which is often inconvenient.

The truck provided with a crane is nowadays utilized in many cases. The loading and unloading operation can then be accomplished with ease utilizing such crane. However, if the temporary house is lifted using a wire sling, the wire contacts the side surfaces of the temporary house, which deforms or damages the wall surfaces. Accordingly, the loading and unloading operation using the wire sling should be carried out carefully, which takes time and is troublesome. It is very convenient if the temporary toilet can be lifted by the crane of the truck without damaging the temporary toilet.

SUMMARY OF THE INVENTION

It is a first object of the present invention to provide a raw sewage disposal apparatus capable of meeting the demand for improvements in the conventional raw sewage disposal apparatus and proposed raw sewage apparatus.

To achieve the first object of the present invention, the raw sewage disposal apparatus, according to the first aspect of the present invention, comprises a heat-resistant vessel for containing raw sewage therein, a stirring means having a plurality of stirring blades for stirring the raw sewage in the vessel, a plurality of heat-holding bodies contained in the vessel, an introduction pipe for connecting the drying cauldron and a stool, a closing means provided in the introduction pipe, a urine stool for receiving urine, a urine tank for containing urine, a discharge pipe interposed between the urine tank and the drying cauldron, a valve means interposed along the discharge pipe for discharging the urine from the urine tank to the stool, and an air supply means which is connected to the urine tank for pressurizing the urine tank.

It is a second object of the present invention to provide a prefabricated structure for accommodating the raw sewage disposal apparatus to meet the demand for the conventional temporary house as set forth above.

To achieve the second object of the present invention, the prefabricated structure comprises a base which is installed on the ground, a side wall portion which is hollow inside and is placed on the base, and a roofed portion which is placed on the side wall portion so as to cover the interior thereof, and further comprising a lifting body having a pair of struts which are fixedly connected to the side surface of the base and extend to the roofed portion along the side surface of the side wall portion, and a plurality of scaffold plates connected between the pair of struts in a given interval.

DESCRIPTION OF THE PREFERRED EMBODIMENT

First Embodiment (FIGS. 1 to 9)

Figure 1:
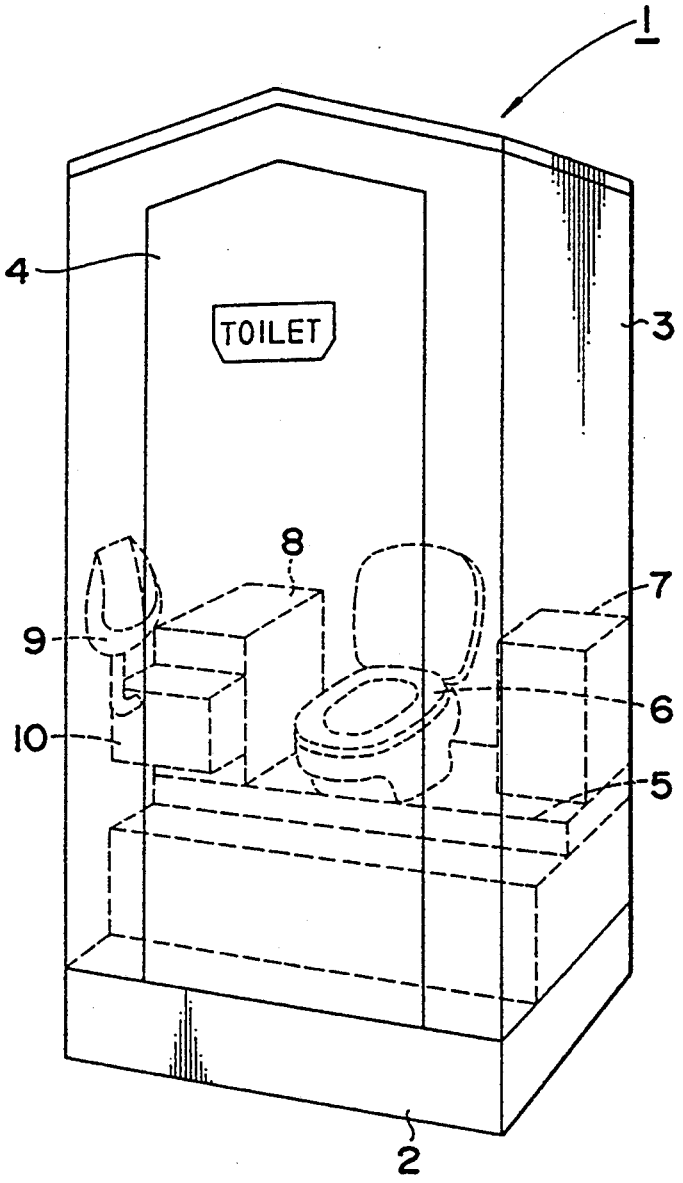
FIG. 1 is a perspective view of a raw sewage disposal apparatus employed in a temporary toilet according to a first embodiment of the present invention.
Figure 2:
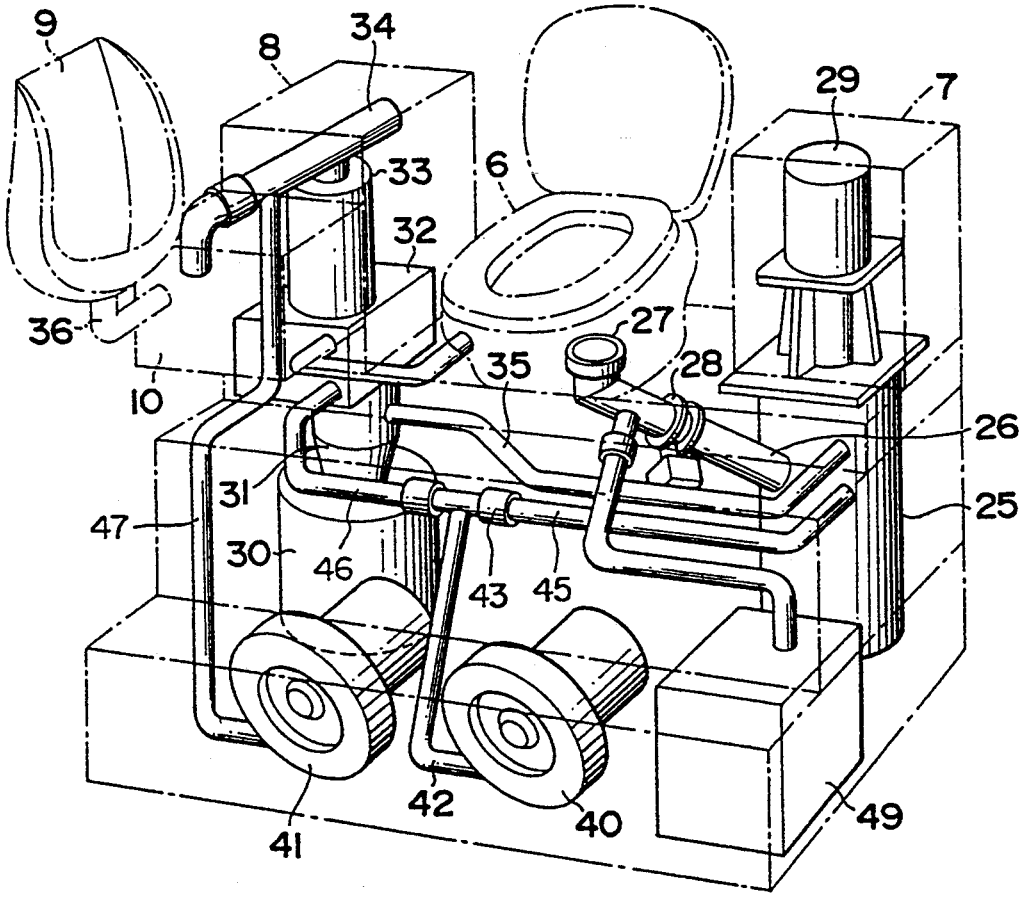
FIG. 2 is a cross-sectional view showing the internal structure of the raw sewage disposal apparatus of FIG. 1.

A raw sewage disposal apparatus, according to a first embodiment of the present invention, will be described with reference to FIGS. 1 to 9. Described in the first embodiment is a temporary toilet housing 1, incorporating a raw sewage disposal apparatus, movable by a truck or the like. In FIG. 1, the temporary toilet housing 1 is made of plastic or reinforced synthetic resin and has a hollow box-like shape. The toilet housing 1 has a base 2 which can be supported on the ground and which has a roofed house 3 fixed thereto. A door 4 is attached to a front portion of the house 3. The temporary toilet housing 1 has inside thereof a raw sewage disposal apparatus 5 which is fixed to an upper portion of the base 2. A stool 6 is fixed to an upper portion of the disposal apparatus 5 for receiving the raw sewage. The base 2 has a cover 7, which is fixed at a right side thereof for housing a motor therein and a cover 8 which is fixed at a left side thereof for housing a catalyst therein. A urine stool (i.e. a urinal) 9 is fixed inside the house 3 at the left side in FIGS. 1 to 4 and a urine tank 10 is provided under the urine stool 8 for containing the discharge urine. The raw sewage disposal apparatus is assembled as a unit which is capable of operating by itself and generally comprises a drying mechanism, a blowing mechanism, a collection mechanism and a cleaning mechanism.

The raw sewage disposal apparatus 5 comprises a cylindrical drying cauldron 25 fixed to the right innermost portion thereof and an introduction pipe 26 connected to the central side portion of the drying cauldron 25, which pipe is inclined with respect to the vertical toward the upper portion thereof. The upper end of the introduction pipe 26 extends to a lower portion of a stool 6. A shutter valve 27 is interposed between the upper portion of the introduction pipe 26 and the stool 6. A valve mechanism 28, such as a butterfly valve or the like, is disposed in the inclined intermediate portion of the introduction pipe 26. A drive mechanism 29 is fixed to the upper portion of the drying cauldron 25 for stirring the raw sewage stored therein. The drive mechanism 29 is covered by the cover 7. A dust collection box 30 is provided at the left innermost lower portion of the raw sewage disposing apparatus 5 for collecting the separated dust. A cyclone dust collector 31 is connected to the upper portion of the dust collection box 30 and is connected to a secondary heater box 32. A cylindrical catalyst box 33 is connected at the lower portion thereof to the upper portion of the secondary heater box 32 and is also connected at the upper portion thereof to an ejector 34 which is disposed in parallel with the secondary heater box 32 for drawing the fresh air therein. A discharge pipe 35 is connected between the upper side portion of the drying cauldron 25 and the cyclone dust collector 31.

The raw sewage disposal apparatus 5 further comprises the urine stool 9 which is provided at the left front portion thereof. The urine stool 9 is connected to the urine tank 10 by an introduction pipe 36.

Two air blowers 40 and 41 are disposed at the right and left front lower portions of the raw sewage disposal apparatus 5. A discharge pipe 42 is connected at one end to the air blower 40 and is branched at the other end thereof. One branch of the discharge pipe 42 is connected to one end of an air introduction pipe 45 by way of a closing valve 43. The other branch connects to an air introduction pipe 46 which is connected to the side surface of the secondary heater box 32. A discharge pipe 47 connected to the air blower 41 communicates with one end of the ejector 34. The raw sewage disposal apparatus 5 further has an overflow tank 49 which is disposed at the right front lower portion thereof.

Figure 3:
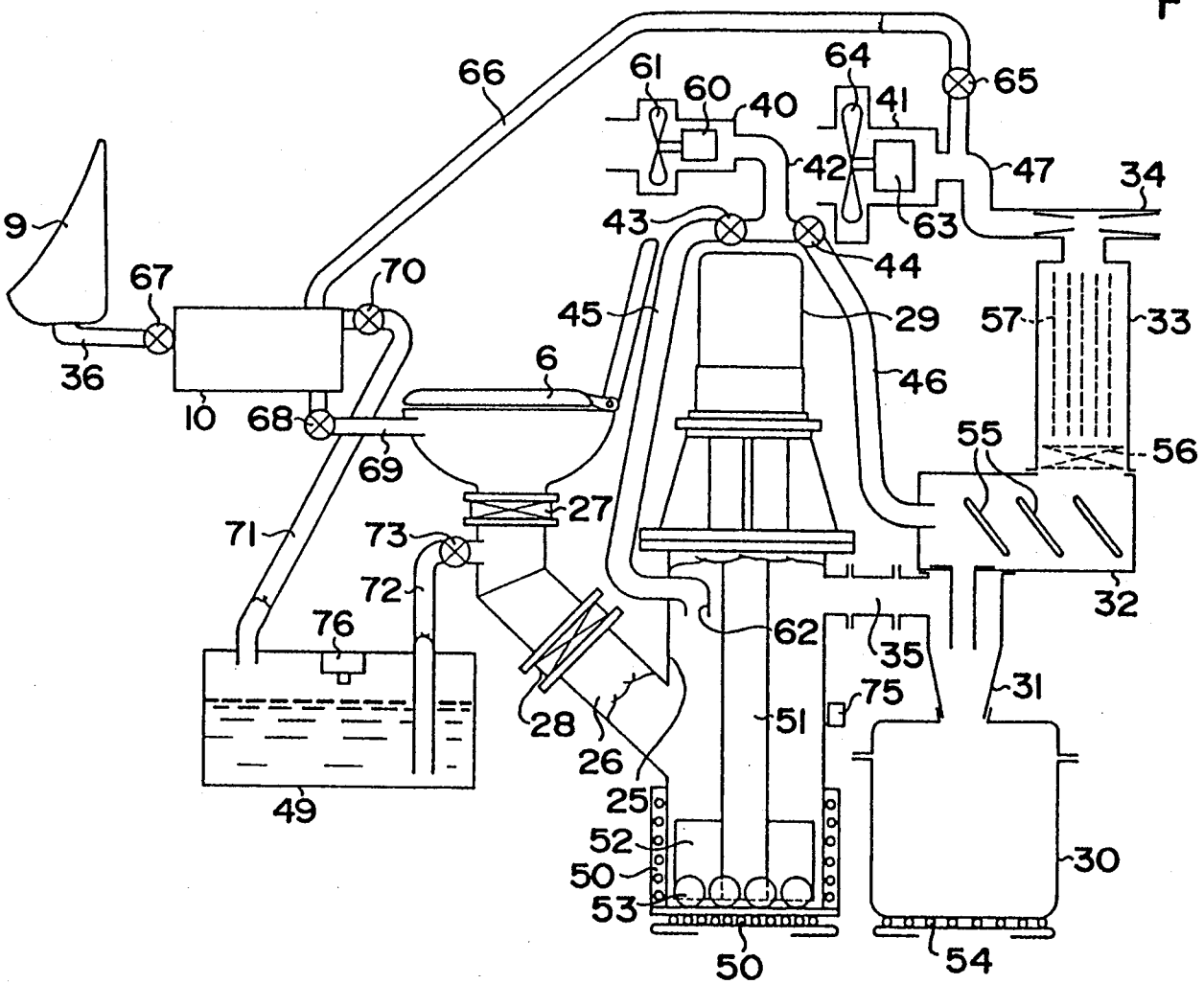
FIG. 3 is a view showing a piping system for connecting the components of the raw sewage disposal apparatus of FIG. 1.

FIG. 3 shows the piping system between the evaporation cauldron 25, the dust box 30, the stool 6, the urine stool 9 and the overflow tank 49.

The stool 6 is connected to the shutter valve 27 which is connected to an open end of the introduction pipe 26. The introduction pipe 26 is inclined aslant relative to the drying cauldron 25 and is connected to the central side surface of the drying cauldron 25. A valve mechanism 28 is interposed midway along the introduction pipe 26. The drying cauldron 25 for heating the discharged raw sewage and evaporating the water thereof is cylindrical and hollow and has a bottom wall at the lower end thereof. A heater 50 is wound around the bottom of the drying cauldron 25 and the lower side periphery thereof. A drive mechanism 29, such as a motor or the like, is mounted on the upper portion of the drying cauldron 25. The upper open end of the drying cauldron 25 is closed by the drive mechanism 29. A rotary shaft 51 extends from the bottom surface of the drive mechanism 29 toward the bottom portion of the drying cauldron 25 and has a lower end provided with stirring blades 52 protruding therefrom. Stored inside the drying cauldron 25 is a plurality of spherical heat-holding bodies 53 to be moved about by rotation of the stirring blades 52. The heat-holding bodies 53 are formed of a high heat-holding material, such as $Al_2O_3$. A temperature sensor 75, which measures the temperature of the drying cauldron 25, is brought into contact with the side surface of the drying cauldron 25.

A vent is open at the upper side surface of the drying cauldron 25 and a discharge pipe 35 for flowing the vapor is connected to the vent. The discharge pipe 35 is connected at the other end thereof to the dust collector 31. The dust collector 31 is of the cyclone type and is constructed in such a manner that the inner diameter thereof progressively diminishes in a downward direction. The dust collector 31 is connected to the upper portion of the dust collection box 30 which is hollow inside thereof and is composed of a separable cover and a barrel. A heater 54 contacts the bottom surface of the dust collection box 30 for evaporating the condensed water included in the collected dust which is separated from the air.

A secondary heat box 32 is connected to the upper portion of the dust collector 31. The inside of the secondary heat box 32 communicates with the inside of the dust collector 31 for receiving gas therefrom. As a result, the air from which only the dust has been removed is introduced into the secondary heat box 32. A plurality of secondary heaters 55 are arranged inside the secondary heat box 32 and are substantially inclined so as to contact the air flow. A catalyst box 33 is mounted on the secondary heat box 32 and communicates therewith. The catalyst box 33 has a filter 56 at the inner lower portion thereof and the upper portion thereof is filled with a catalyst 57 composed of platinum and the like. The ejector 34 for drawing the air by negative pressure is connected to the upper portion of the catalyst box 33 for discharging the air inside the catalyst box 33.

A fan 61 driven by a motor 60 is housed in the air blower 40. The fresh air supplied under high pressure by the air blower 40 is branched into air introduction pipes 45 and 46 which are closable by first and second closing valves 43 and 44. One end of the air introduction pipe 45 is connected to the first closing valve 43 and its other end is connected to the upper portion of the drying cauldron 25. A nozzle 62 of the air introduction pipe 45 is open and is directed toward the lower portion of the drying cauldron 25. The air introduction pipe 46 connected to the second closing valve 44 communicates with the side wall of the secondary heat box 32. The air blower 41 has inside thereof a motor 63 and a fan 64 driven by the motor 63. The air supplied under high pressure by the air blower 41 is supplied to the ejector 34 by way of the air introduction pipe 47. The air introduction pipe 47 is connected to an air pressure pipe 66, which pipe 66 is connected to the upper portion of the urine tank 10.

The urine tank 10 is airtight and box-shaped. A valve 67 is disposed midway along the introduction pipe 36 and at the portion where the introduction pipe 36 is connected to the urine tank 10. A jet pipe 69 is connected to the lower portion of the urine tank 10 and communicate with the inside of the stool 6. A valve 68 is disposed midway along the jet pipe 69. A discharge pipe 71 has an upper end which is connected to the upper side surface of the urine tank 10 by way of the valve 70 and a lower end which is connected to the upper portion of the overflow tank 49. The overflow tank 49 is disposed lower than the urine tank 10 so that the urine in the urine tank flows into the overflow tank by gravity. A discharge pipe 72 is connected to the overflow tank 49 and has a lower end opening which extends to a position close to the bottom of the overflow tank 49. An upper end of the discharge pipe 72 is connected to the side surface of the introduction pipe 26 by way of a valve 73. A float sensor 76 is disposed at the inner upper portion of the overflow tank 49 for detecting the liquid surface of the urine contained therein.

Figure 4:
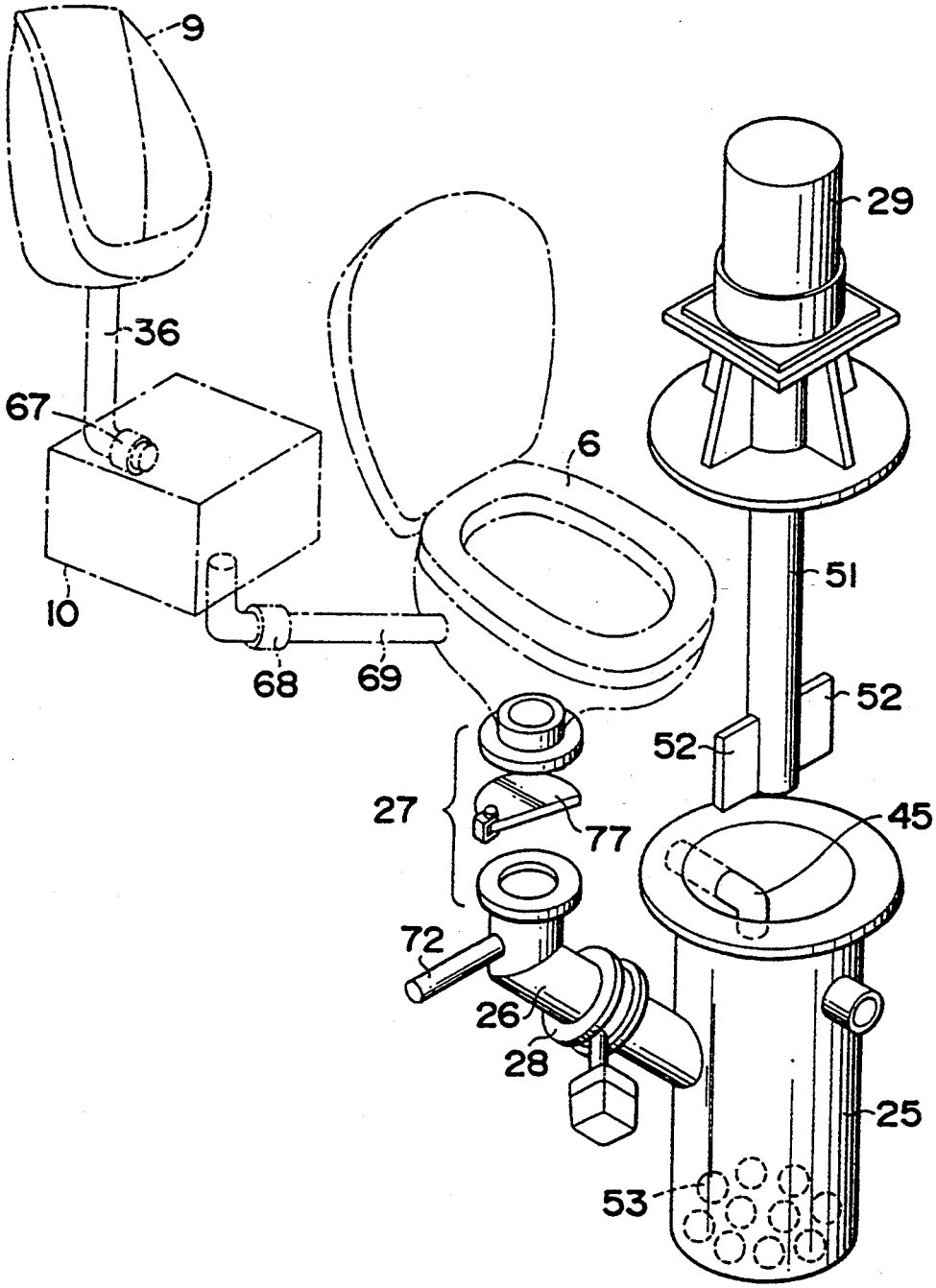
FIG. 4 is an exploded perspective view showing a drying cauldron and a stool.

FIG. 4 shows an exploded perspective view illustrating the relation between the stool 6, the drying cauldron 25, the introduction pipe 26, the urine stool 9, etc. In FIG. 4, a shutter plate 77 which is closable in a horizontal direction is supported inside the shutter 27. The horizontal motion of the shutter plate 77 opens and closes the communication between the stool 6 and the introduction pipe 26.

Figure 5:
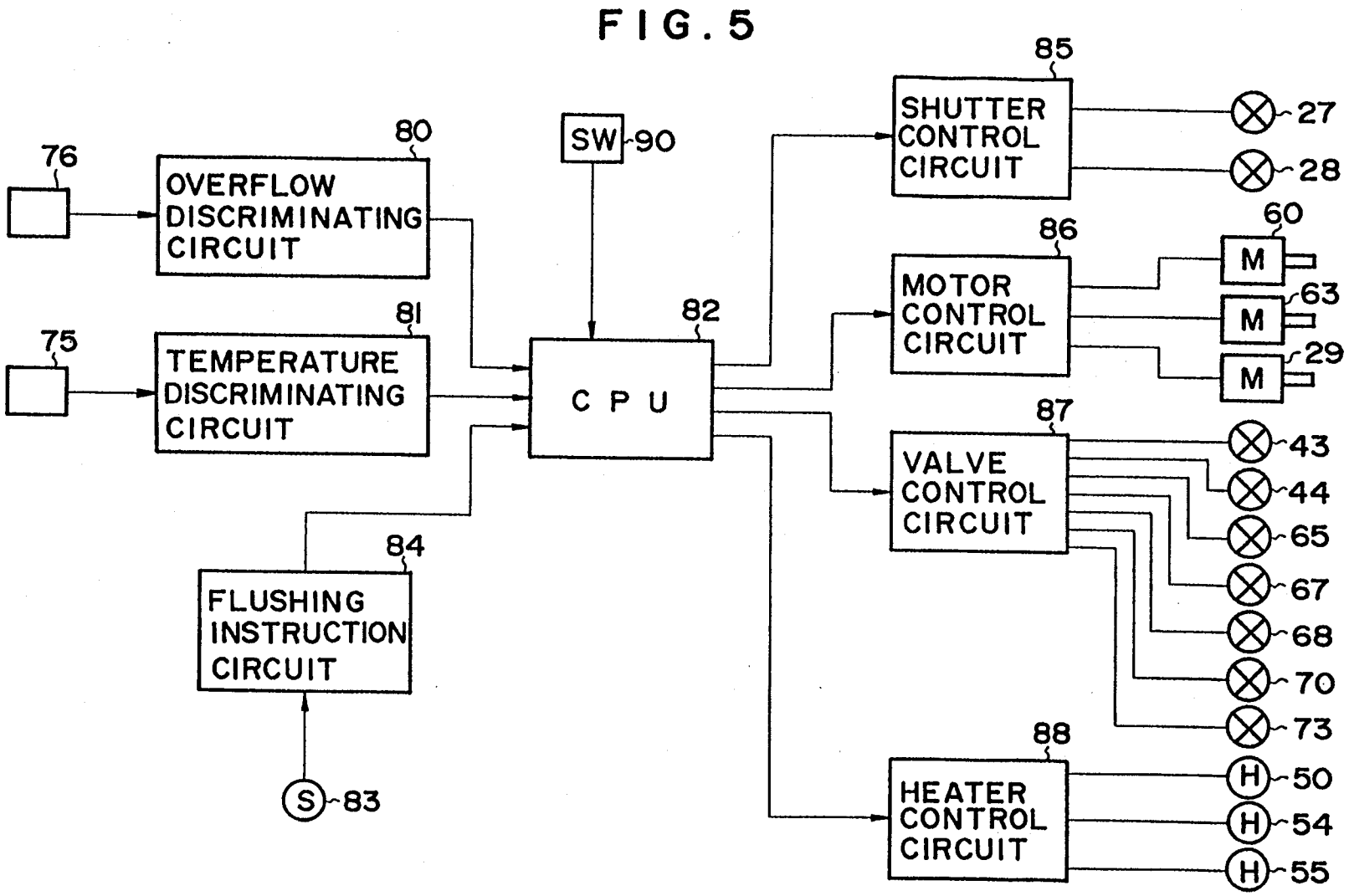
FIG. 5 is a block diagram showing a control system of the raw sewage disposal apparatus of FIG. 1.
Figure 6:
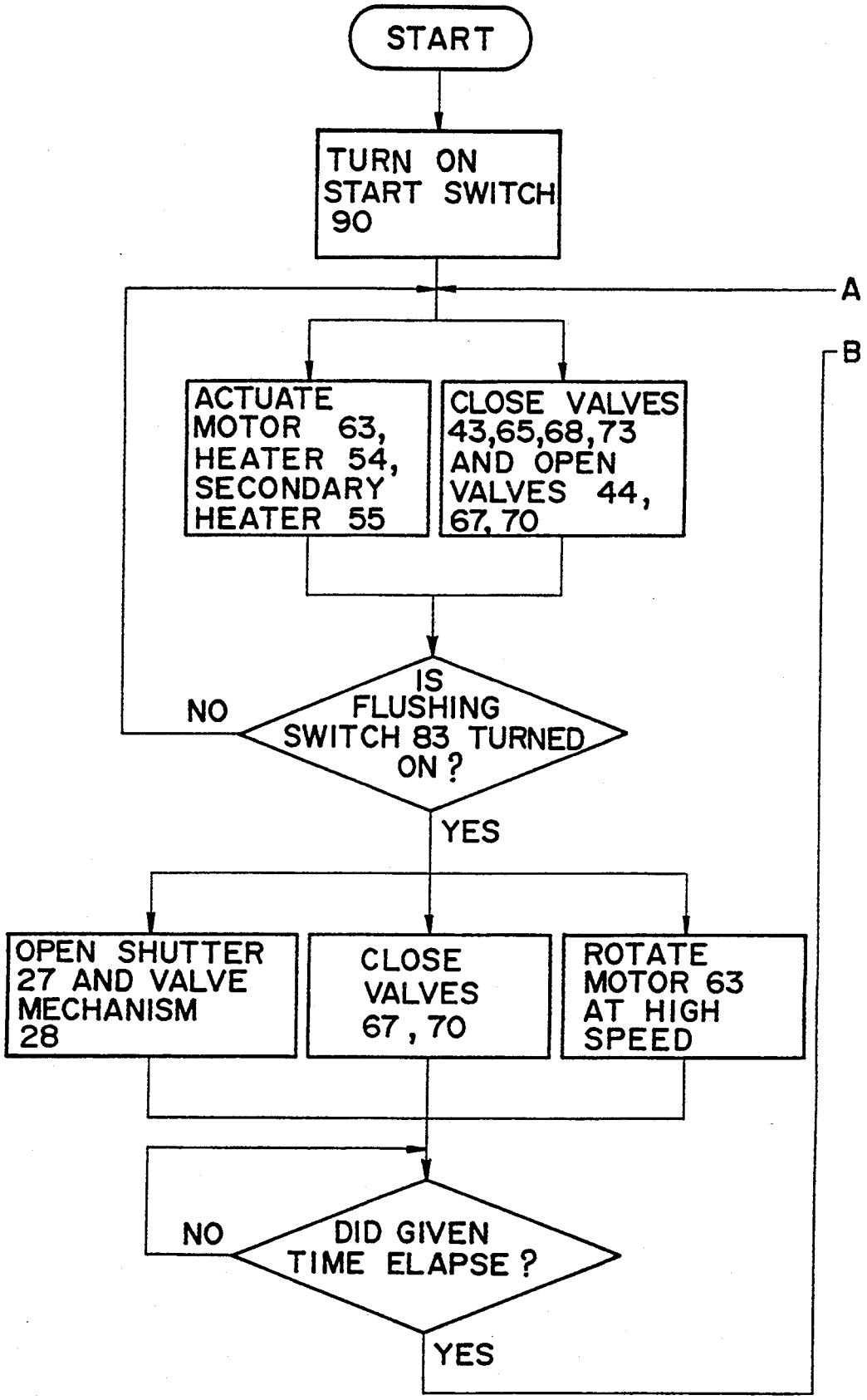
FIGS. 6 to 9 are flow charts showing operations of the raw sewage disposal apparatus of FIG. 1.
Figure 7:
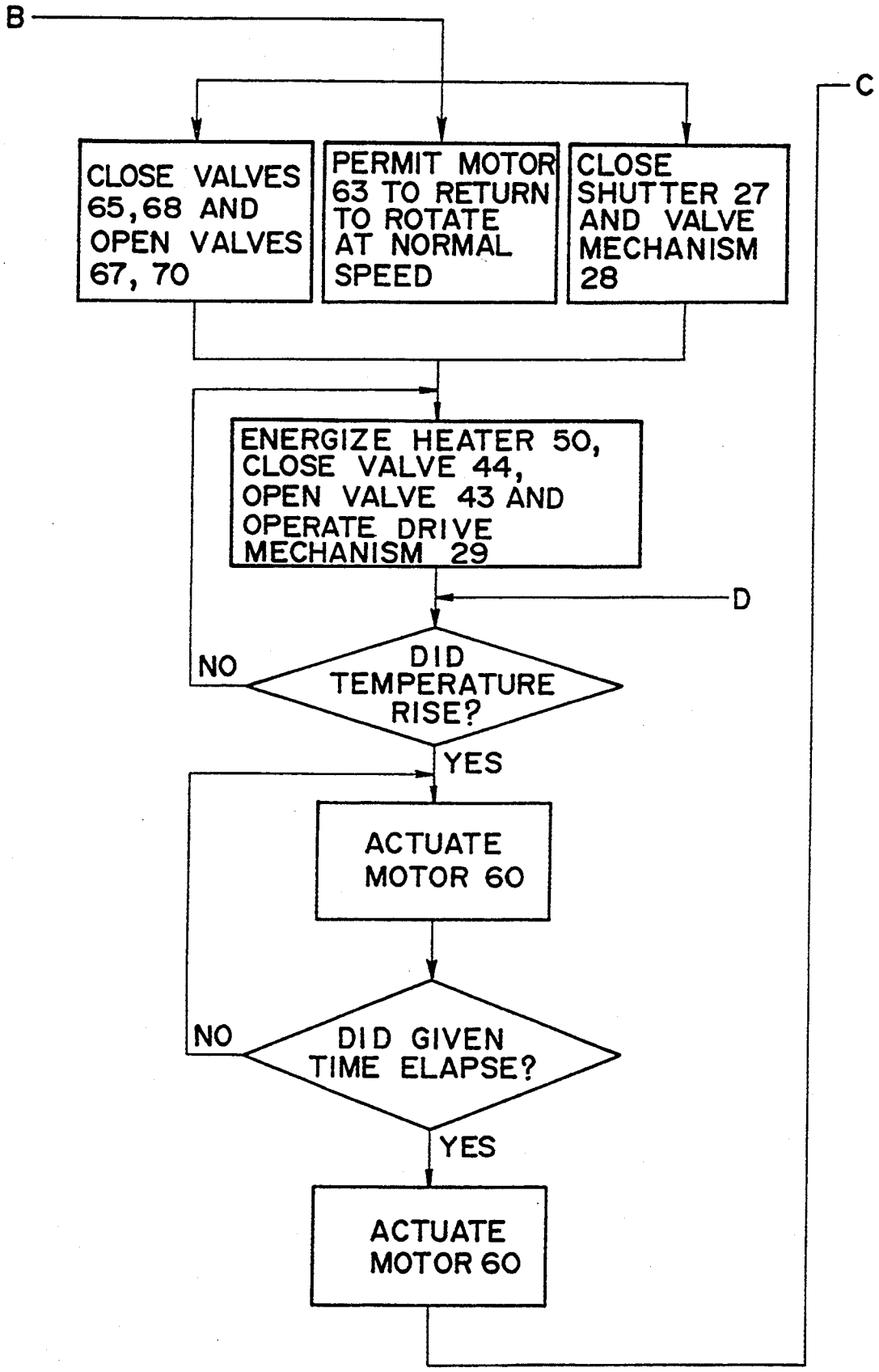
Figure 8:
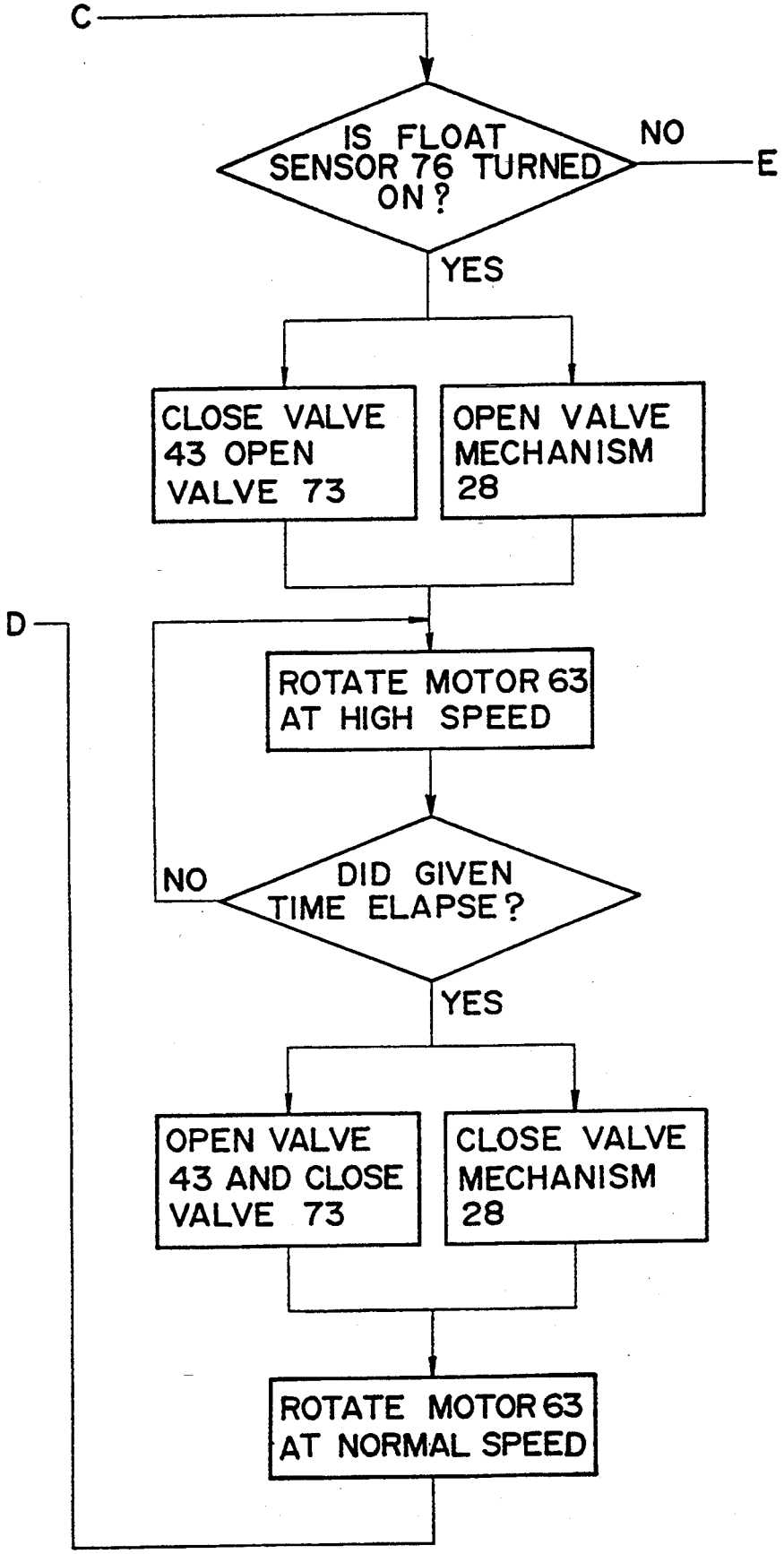
Figure 9:
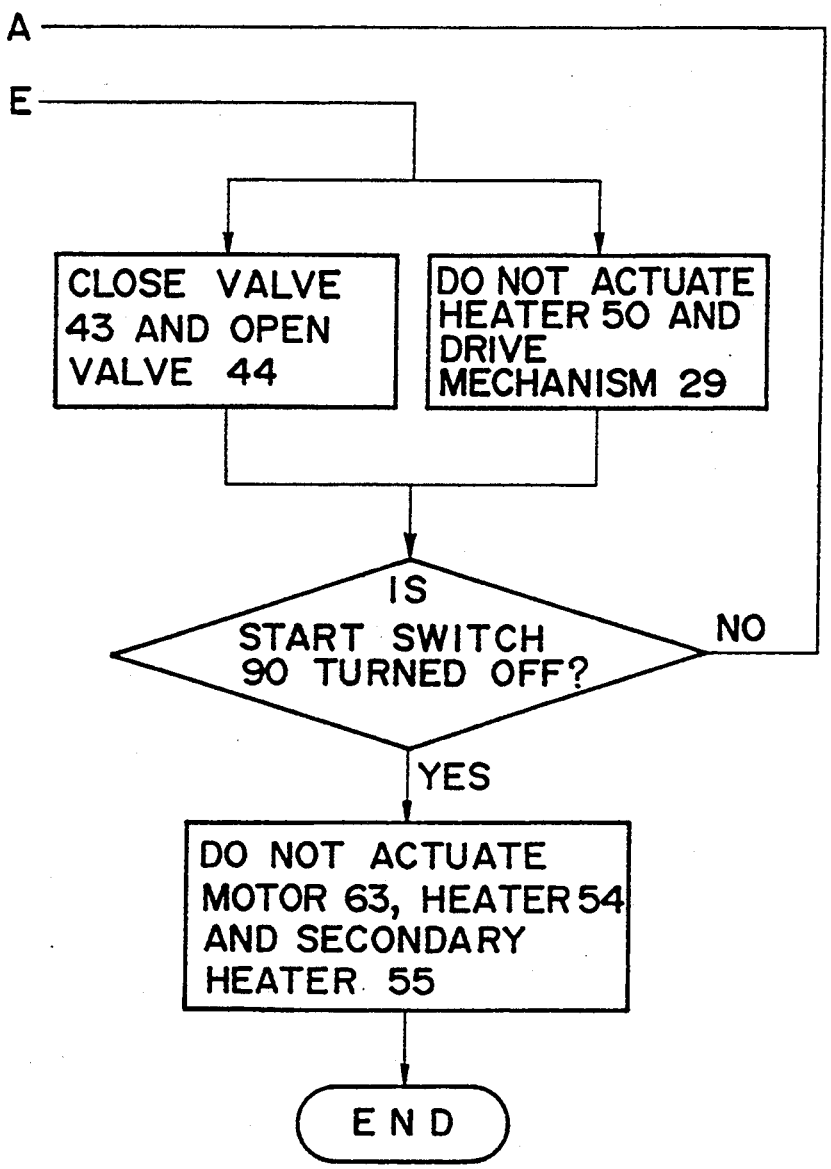

FIG. 5 is a block diagram showing the control system according to this embodiment. An output of the float sensor 76 is connected to an overflow discrimination circuit 80, the output of which is connected to a CPU 82 composed of a microcomputer, etc. An output of the temperature sensor 75 is connected to a temperature discrimination circuit 81, the output of which is connected to the CPU 82. An output of a flushing switch 83, which is used by the user after he used the stool 6, is connected to a flushing operation circuit 84, the output of which is connected to the CPU 82. Outputs of the CPU 82 are supplied to a shutter control circuit 85, a motor control circuit 86, a valve control circuit 87 and a heater control circuit 88. These circuits 85, 86, 87 and 88 control, upon reception of instructions from the CPU 82, each mechanism connected thereto. The shutter 27 and the valve mechanism 28 are connected to the shutter control circuit. The motor 60 of the blower 40, the motor 63 of the blower 41 and the drive mechanism 29 are respectively connected to the valve control circuit 87. Heaters 50, 54 and the secondary heater 55 are connected to the heater control circuit 88. A start switch 90, which instructs to start the raw sewage disposal apparatus 5, is connected to the CPU 82.

The operation of the first embodiment will be described hereinafter.

Before disposing of the raw sewage by the raw sewage disposing apparatus 5, the raw sewage apparatus should be placed in the standby state.

At first, the start switch 90 is turned on to supply the CPU 82 instructions to start the disposal operation by the raw sewage disposal apparatus 5. The instruction is transmitted to the motor control circuit 86, the valve control circuit 87 and the heater control circuit 88. The heater 54 and the secondary heater 55 are energized to heat the dust collection box 30 and the secondary heat box 32. At the same time, only the motor 63 is driven so that the air supplied under high pressure by the air blower 41 is supplied to the ejector 34 by way of the air introduction pipe 47. The motor 60 is stopped. The first closing valve 43 is closed but the second closing valve 44 is open. The valves 65, 68 and 73 are closed but the valves 67 and 70 are open. When the air flows at high speed in the ejector 34, the inside of the catalyst box 33 connected to the ejector 34 is negatively pressurized to thereby draw the air from inside the catalyst box 33 and direct it outside the catalyst box 33.

Successively, by the negative pressure generated by the air passing the ejector 34 there is formed an air route through which the fresh air circulates in the air blower 40, the air introduction pipe 42, the air introduction pipe 46, the secondary heat box 32 and the catalyst box 33. Accordingly, the fresh air is heated by the secondary heater 55 in the secondary heat box 32 whereby the hot air flows through the catalyst 57. As a result, the catalyst 57 is heated. At a low temperature, the catalyst 57 does not effectively oxidize the oxidizable components of the discharge gas at all. It is necessary to warm the catalyst 57 at a given temperature for eliminating the bad smell.

When the raw sewage disposal apparatus 5 is in the standby state, the urine stool 9 can be used. When using the temporary toilet 1, the user opens and enters the door 4 and urinates into the urine stool 9. The discharged urine passes through the introduction pipe 36, the valve 67 and is stored in the urine tank 10. When the urine is stored in the urine tank 10 over a predetermined amount, the urine tank 10 is in an overflow state. At this time, the urine exceeding the predetermined amount passes the valve 70 and flows into the overflow tank 49 from the discharge pipe 71. Accordingly, a predetermined amount of urine is always stored in the urine tank 10 and the overflow is stored in the overflow tank 49.

The user, who uses the temporary toilet 1, sits on the stool 6 and excretes toward the stool 6. The discharged raw sewage is temporarily stored on the upper portion of the shutter 27.

The user presses, after the stool 206 has been used, a flush switch 83 so that the stool 6 is flushed and the discharged raw sewage can be introduced into the drying cauldron 25. When the flush switch 83 is pressed, a flushing instruction is supplied to the flushing operation circuit 84 and then to the CPU 82. The CPU 82 instructs the shutter control circuit 85 to open the shutter 27 and the valve mechanism 28. As a result, the introduction pipe 26 is open so that the stool 6 communicates with the drying cauldron 25 and the discharged raw sewage flows through the introduction pipe 26 and flows into the drying cauldron 25.

At the same time, the CPU 82 instructs the motor control circuit 86 to increase the rpm of the motor 63 so that the amount of the air, which flow into the air introduction pipe 47, is increased. Thereafter, the valves 67 and 70 are closed while the valves 65 and 68 are open at the same time. Then, the air pressure from the air blower 41 is transmitted to the urine tank 10 through the air pressure pipe 66 so that the air pressure is applied to the urine stored in the urine tank 10. Accordingly, since the valve 68 is open, the urine is jetted under high pressure toward the inner wall of the stool 6 from the jetting pipe 69 which is connected to the bottom portion of the urine tank 10, whereby the filth in the stool 6 is washed and the inner portion of the introduction pipe 26 is cleaned down. The valves 65 and 68 are open for only a short period of time for preventing a large amount of the urine from flowing from the urine tank 10. After the valves 65 and 68 are open for a predetermined time, the valve control circuit 87 closes the valves 65 and 68 and thereafter opens the valves 67 and 70 so that these valves operate in the former state. After the stool 6 is cleaned by the motor control circuit 86 and the valve control circuit 87, the motor control circuit 86 return the rpm of the motor 63 to the former state and reduces the air pressure. The shutter control circuit 85 instructs the shutter 27 and the valve mechanism 28 to close so that the stool 6 no longer communicates with the drying cauldron 25.

After the raw sewage and the urine are introduced into the drying cauldron 25 by the operation of the shutter 27 and the valve mechanism 28, the raw sewage and the urine are evaporated and dried in the following manner.

The CPU 82 instructs the valve control circuit 87 and the heater control circuit 88 to close the second closing valve 44 and at the same time open the first closing valve 43. At this time, the air blower 40 is not yet operated, hence another air route is formed through which the air drawn by the ejector 34 circulates in the stopped air blower 40, the air introduction pipe 42, the air introduction pipe 45, the nozzle 62, the drying cauldron 25, the discharge pipe 35, the dust collector 31, the secondary heat box 32 and the catalyst box 33. With the formation of this route, the fresh air is always jetted by the nozzle 62 into the drying cauldron 25 to thereby facilitate the oxidation of the raw sewage to be dried.

At the same time, the heater control circuit 88 energizes the heater 50 so that the drying cauldron 25 is heated. The bottom and the periphery of the drying cauldron 25 heated by the heater 50 so that the temperature of the raw sewage and the urine increases to reach the boiling point.

When the motor in the drive mechanism 29 is actuated by the motor control circuit 86, the rotary shaft 51 is rotated and the stirring blades 52 are rotated at the portion adjacent to the bottom of the drying cauldron 25. At this time, the heat-holding bodies 53 are agitated by the stirring blades 52 at the portion adjacent to the bottom of the drying cauldron 25 to thereby stir the raw sewage. As a result, the raw sewage is mixed at a uniform temperature while the heat accumulated in the heat-holding bodies 53 are spherical and have large surfaces, whereby drying of the raw sewage is expedited and the liquid component thereof is forced to evaporate. The vapor formed by the evaporation of the liquid component is discharged from the discharge pipe 35 and introduced into the dust collector 31 and moves through a vertical path at high speed like a cyclone. The dust included in the evaporated liquid component is stored inside the dust collection box 30. A small amount of the liquid component is included in the dust. The liquid component included in the dust is evaporated again by the heat of the heater 54. The dust and the re-evaporated liquid water are introduced into the secondary heat box 32 from the pipe located in the center of the dust collector 31. Since the air is drawn toward the secondary heat box 32 due to the negative pressure in the ejector 34, the liquid component and the air including the bad smell evaporated in the drying cauldron 25 and the dust collection box 30 are introduced into the secondary heater 55 and are heated to the temperature at which the catalyst 57 can perform its oxidation operation. Successively, the evaporated liquid component passes the filter 56 and contacts the catalyst 57 whereby the bad smell component in the evaporated liquid component is oxidized and decomposed. As a result, the bad smell component is changed into an odorless component. Thereafter, the air is drawn by the ejector 34 and diffused outside. In such a manner, the liquid component of the raw sewage in the drying cauldron 25 is successively evaporated and diffused into the atmosphere by the circulation of the air in the drying cauldron 210.

The liquid component which is the main component of the raw sewage stored in the drying cauldron 25 is evaporated by both the heat from the heater 50 and the stirring operations by the stirring blades 52 and the heat-holding bodies 53. The materials that remain last in the drying cauldron 25 are mainly nonevaporable cellulosic substances. If these residual substances are allowed to accumulate in the drying cauldron 25, succeeding drying operations cannot be efficiently performed. Accordingly, every time the drying operation is completed, the residual substances and the dust should be removed and thereafter the drying cauldron should be cleaned. The cleaning operation can be effected automatically when it is judged that all the raw sewage in the drying cauldron is dried.

When the liquid component of the raw sewage has been discharged from the drying cauldron 25, the temperature of the peripheral surface of the drying cauldron 25 rises and this is detected by a temperature sensor 75. The detected signal is supplied to the temperature discrimination circuit 81. The temperature discrimination circuit 81 transmits the result to the CPU 82. The CPU 82 issues the cleaning instruction. At this time, the motor drive circuit 86 actuates the motor 60 so that the fresh air is forced to flow from the blower 40, under high pressure, through the air introduction pipe 42, the first valve 43 which is now open and the air introduction pipe 45. The air is jetted toward the inside of the drying cauldron 25 by the nozzle 62. As a result, the dust and the residual substances in the drying cauldron 25 are blown up in the form of fine particles. The blown up dust and the residual substance are supplied to the dust collector 31 through the discharge pipe 35. The dust is separated from the air by the dust collector 31 and the dust alone is accumulated in the dust collection box 30. At this time, the drive mechanism 24 is continuously operated to thereby agitate the heat-holding bodies 53 at the portion adjacent to the bottom of the drying cauldron 25 whereby the nonevaporated residual substances which are adhered to the bottom and the inner wall of the drying cauldron 25 are crushed minutely. The CPU 82, after the cleaning operation is completed for the predetermined time, stops the cleaning operation.

After the residual substances in the drying cauldron 25 have been removed therefrom by the air under pressure from the air blower 40, the stool 6 is returned to the standby state for the next user. At first, the CPU 82 supplies signals to the motor control circuit 86, the valve control circuit 87, and the heater control circuit 88 so that the motor 60 and the drive mechanism 29 are stopped and the heater 50 is deenergized. The valve 44 is open and the valve 43 is closed.

However, the motor 63 is driven so that the air flows through the secondary heater box 32 and the catalyst box 33, whereby the temperature is always kept to operate the catalyst 57. Accordingly, the air drawn by the ejector 34 is circulated in the secondary heat box 32 and the catalyst box 33 through the stopped air blower 40, air introduction pipe 42, and the air introduction pipe 46. The air circulation is continued for preventing the temperature in the catalyst 57 from being reduced and for maintaining the raw sewage disposal apparatus 5 in a standby condition for the next drying operation. If the temporary toilet is used for a long period of time, the urine stool 9 is frequently used. The urine which overflows the urine tank 10 flows through the discharge pipe 71 and is stored in the overflow tank 49. However, since the overflow tank 49 has a limited capacity, the urine can be stored in the overflow tank only until it overflows the overflow tank 49. Accordingly, it is necessary to evaporate the urine in the overflow tank 49.

Firstly, the increase of the liquid surface of the urine stored in the overflow tank 49 is detected by the float sensor 76. The float sensor 76 issues a detected signal which is supplied to the overflow discrimination circuit 81 and then supplied to the CPU 82. The CPU 82 judges that the overflow tank 49 is filled with urine and actuates the shutter control circuit 85 so that the valve mechanism 28 is opened by the shutter control circuit 85. At the same time, the valve control circuit 87 opens the valve 73 and closes the valves 43 and 44. The motor control circuit 86 rotates the motor 63 at high speed so that the ejector 34 can enhance the drawing force. Then, the route is formed by the introduction pipe 26, the drying cauldron 25, the discharge pipe 35, the dust collector 31, the secondary heater box 32 and the catalyst box 33 and the negative pressure is applied to the discharge pipe 72. The urine in the overflow tank 49 is sucked by the discharge pipe 72 and successively introduced into the drying cauldron 25. To control the air flow, the valve 67 is closed and the valve 65 is open. Then, the pressure of the air flow from the air blower 41 is applied to the urine tank 10 through the pressure pipe 66. Since the valve 70 is open, the pressure of the air is applied to the overflow tank 49 through the discharge pipe 71, which assists the introduction of the urine from the discharge pipe 72 into the drying cauldron 25. If this operation continues for a predetermined time, all the urine stored in the overflow tank 49 is transferred to the drying cauldron 25, and hence the overflow tank 49 becomes substantially empty. Thereafter, the CPU 82 actuates the shutter control circuit 85 to close the valve mechanism 28 and actuates the motor control circuit 86 to reduce the rpm of the motor 63. The valve control circuit 87 closes the valve 73 and opens the valve 43. The heater control circuit 88 energizes the heater 50 so that the heater starts to evaporate the urine in the drying cauldron 25. The evaporating operation of the urine is the same as that of the raw sewage.

The temporary toilet 1 is in standby state for the next user after the raw sewage in the stool 6 is dried or the urine in the overflow tank 49 is evaporated. Accordingly, the CPU 82 is returned to the standby state until the next user presses the flushing switch 83 to issue the flushing instruction. For this reason, the valves 43, 65, 73 and 68 are closed and the valves 44, 67 and 70 are open. Although the motor 63 continues to operate, the motor 60 and the drive mechanism 29 stops while the heater 54 and the secondary heater 55 are kept energized. Accordingly, the air flows in the route defined by the air blower 40, the air introduction pipe 42, the air introduction pipe 46, the secondary heater box 32, the catalyst box 33 and the catalyst 57 is always kept warmed and is on standby for the next drying and evaporating operations.

With the repetition of these cycles, the temporary toilet 1 is always cleaned and the surplus urine is evaporated so that the raw sewage disposal apparatus 5 can be used for a long period of time.

As described above, it is possible to flush the filthy stool by the urine collected in the urine stool, hence the inside of the stool can be kept clean. Furthermore, since the stool can be cleaned by utilizing the urine, which is evaporated like the raw sewage, water is not necessary to be supplied from a separate water storage tank. Since the urine is dried, it is possible to save energy and to maintain the temporary toilet at low cost.

Even if the urine overflows beyond necessity, the urine can be evaporated automatically in the drying cauldron, and it is not necessary to maintain or inspect the apparatus. As a result, it is not troublesome to maintain the raw sewage disposal apparatus even if it is used for a long period of time.

In addition, the above described connections and mode of operation effectively form a means for preventing recirculation of any urine back into the stool 6.

Second Embodiment (FIGS. 10 to 13)

A prefabricated structure for containing therein a raw sewage disposal apparatus will be described with reference to FIGS. 10 to 13.

The prefabricated structure according to the second embodiment is used as the house for the raw sewage disposal apparatus but this prefabricated structure is not limited thereto and can be applied to various portable houses such as a dressing room, a look out, a selling stand, etc.

The temporary toilet 200 is supported on a base 201 which has a flat bottom. The temporary toilet 200 has a side wall portion 202 which is hollow inside thereof and formed by reinforced plastics or thin steel plate, and a roofed portion 203 which is placed on the side wall portion 202 and has surfaces inclined from the top (or peak) to the four corners thereof. That is, the periphery of the base 201 is surrounded by a thick steel plate and an internal structure of the base 201 is formed of reinforcing members made of steel plates which are connected with each other in monocoque manner for supporting a heavy object. It is possible to raise a portable toilet per se by raising the base 201. The side wall portion 202 has a large opening on the front side thereof and a door 204 is connected along one edge of the opening by hinges. A stool 205 is fixed to the inside of the side wall portion 202 for receiving the discharged raw sewage. The base 201 has insertion grooves 206 which are U-shaped downwardly and disposed thereunder at the right and left thereof and into which forks of a forklift truck can be inserted. The temporary toilet according to the second embodiment can be loaded on a bed of a truck in the state as illustrated in FIG. 10 and conveyed to a destination where the temporary toilet is unloaded from the bed of the truck and installed on the ground so as to be temporarily used.

Figure 10:
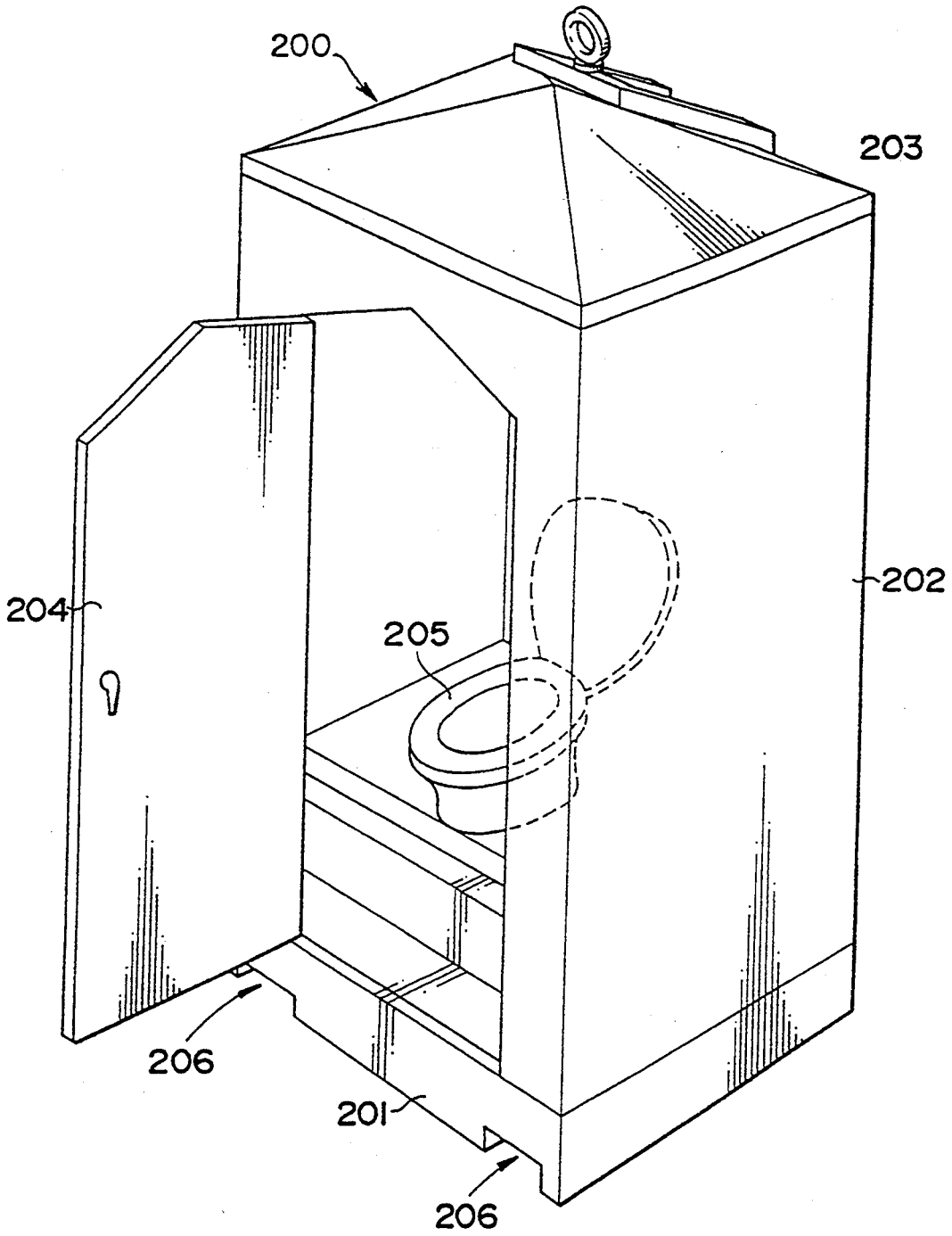
FIG. 10 is a perspective view showing a front portion of the temporary house according to a second embodiment of the present invention.
Figure 11:
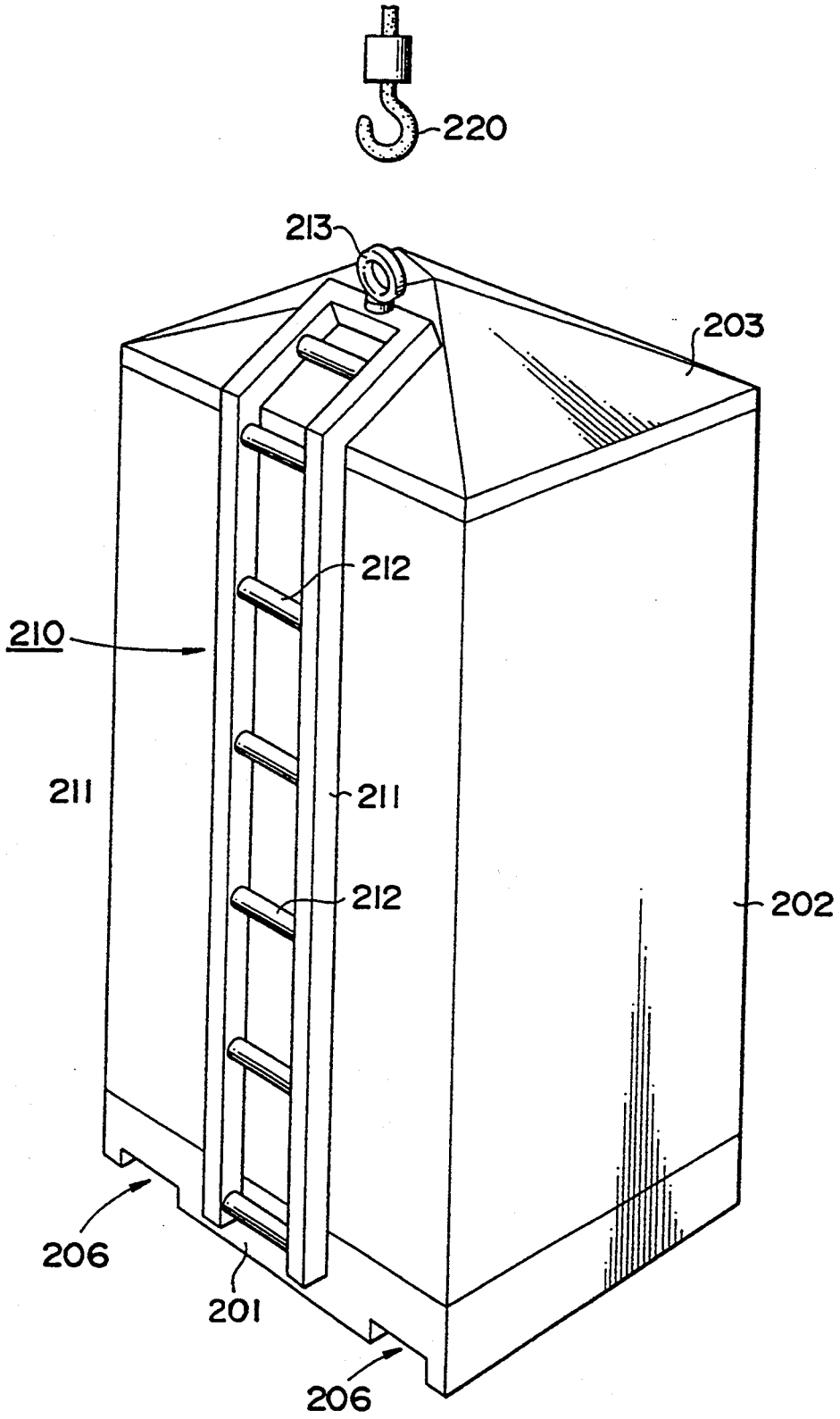
FIG. 11 is a perspective view showing a rear portion of the temporary house of FIG. 10.

FIG. 11 is a rear view of the temporary toilet in FIG. 10, in which a lifting body 210 serving as a lifting mechanism according to the present invention is illustrated. A pair of struts 211 are fixed to a rear wall of the base 201 and disposed perpendicularly in parallel with each other. The pair of struts 211 extend to the roofed portion 203 and in parallel with the side surfaces of the side wall portion 202. The pair of struts 211 are angled inwardly at the boundary between the side wall portion 202 and the roofed portion 203 and are extended upward along the inclination of the roofed portion 203 and are connected to the top of the roofed portion 203. A plurality of horizontal steps or rungs 212 are fixed to the pair of struts 211 at predetermined intervals so as to form a ladder. The rungs 212 act as reinforcing members for the pair of struts 211 and can be used as steps when an operator gets on the roofed portion 203. A ring 213 having a circular opening is fixed to the joining portion which joins the upper ends of the struts 211. These struts 211, rungs 212 and ring 213 are formed of steel and integrally joined by welding. The lifting body 210 per se has significant rigidity relative to stress. Since the lower ends of the struts 211 are fixed to the side surface of the base 201, the struts 211 and the base 201 are integrated so as to be strong. The lifting body 210 comprises these struts 211, rungs 212 and ring 213.

Since the side wall portions 202 and roofed portion 203 are formed of reinforced plastics, glass fibers, thin steel plates, they are weak relatively against impact strength and stress and liable to deform when a strong force is externally applied. Both the base 201 and the lifting body 210 have rigidity while the struts 211 are perpendicular to the base 201. Accordingly, the struts 211 do not impose any stress or pressure against the side wall portion 202 and the roofed portion 203 and are supported by the base 201. As a result, the connections of the base 201 and the struts are very strong against stress and impact strength.

The temporary toilet is moved in the following manner.

The temporary toilet is usually stored in a yard or warehouse and is loaded on the bed of a truck for transport to a use site. The forklift truck is operated to insert the fork into the insertion grooves 206 of the temporary toilet and raise the fork so as to raise the temporary toilet. If the forklift truck is operated, then the temporary toilet can be loaded on the bed of the truck. If the forklift truck is not available, a hook 220 of a crane mounted on the truck is connected to the ring 213 so as to load the temporary toilet on the truck.

The truck loading the temporary toilet thereon travels to the temporary site where the temporary toilet is temporarily installed. Most of the temporary sites are at locations where a forklift truck is not always available. Accordingly, at the temporary site, the crane on the truck is operated to unload the temporary toilet from the bed of the truck. The hook 220 of the crane is engaged with the ring 213, and thereafter the crane is operated to lift the toilet. This lifting force acts on the ring 213 and is transferred through the struts 211 to the base 201. Since the side wall portion 202 and the roofed portion 203 are mounted on the base 201, they are lifted at the same time when the base 201 is listed. Since the weights of the side wall portion 202 and the roofed portion 203 are supported by the base 201, even if they are thin, the struts 211 do not impose stress against the side wall portion 202 and the roofed portion 203 so that the side wall portion 202 and the roofed portion 203 are not deformed or damaged.

Figure 12:
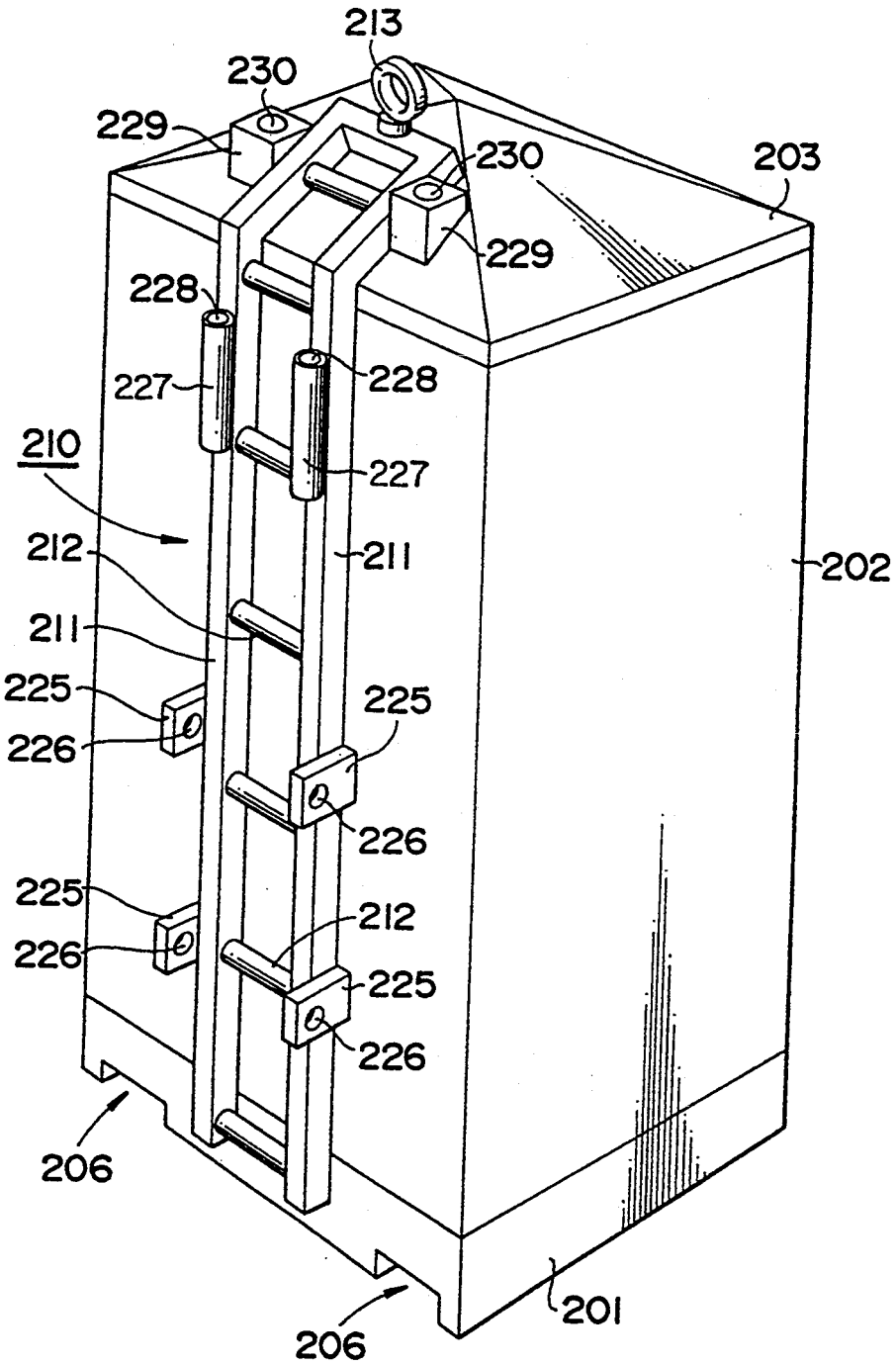
FIG. 12 is a perspective view showing a rear portion of the temporary house according to a modification of the second embodiment of the present invention.

FIG. 12 shows a modification of the second embodiment in which the lifting body 210 is illustrated.

The struts 211 are perpendicularly fixed to the side surface of the base and have connecting pieces 225 formed of steel plates which are fixedly welded at four locations at right and left thereof. The connecting pieces 225 are pierced to form pin holes 226 which are coaxially arranged. Connecting pipes 227 are fixed to the upper portions of the struts 211 and disposed in parallel with each other and have pipe holes 228 which are vertically aligned. A pair of block-shaped connecting bodies 229 are fixed on the roofed portion 203 along the inclined surface thereof. The connecting bodies 229 have vertically penetrated insertion holes 230.

Figure 13:
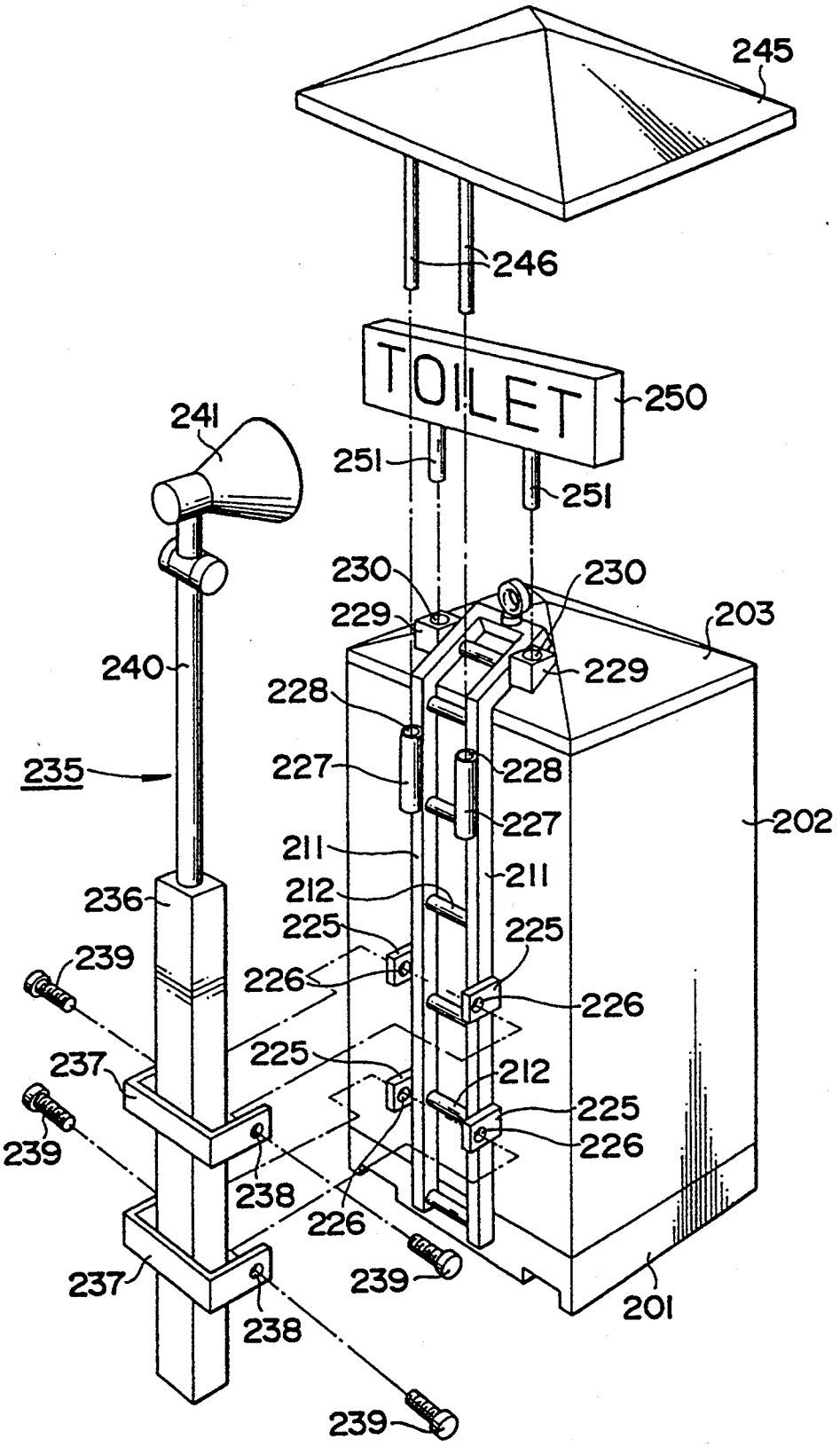
FIG. 13 is a perspective view of the temporary house to which various devices are attached.

The temporary toilet according to this modification can be utilized together with other devices for various purposes. FIG. 13 shows one example of such utilization.

When the temporary toilet is used at night, a luminaire 235 is required for lighting the neighborhood of the temporary toilet. The luminaire is conventionally supported by a stand or a block which is installed on the ground. However, the luminaire can be attached to the temporary toilet according to this modification. The luminaire 235 has a long mast 236 which is hollow inside thereof and extends vertically and a pair of fixing bodies 237 which are bent in U-shapes and fixed in spaced relation to the rear surface of the mast 236 by welding. Opposed side pieces of the fixing bodies 237 are pierced to form pin holes 238. The space between the opposed side pieces is sized to permit the connecting pieces 225 to fit therebetween. A telescopic pipe 240 is slidably inserted into the long mast 236 from the upper end opening thereof and has an upper end thereof to which a light 241 connected to the power source is connected. When the luminaire 235 is attached to the temporary toilet and used, the fixing bodies 237 and the connecting pieces 225 are approached to each other and engaging pins 239 are inserted into the pin holes 238 and 226 and fixed thereby so that the luminaire 235 can be fixed to the rear surface of the struts 211. In such a manner, the temporary toilet can be used as a holder of the luminaire 235 at a festival or a meeting at night. When both the temporary toilet and the luminaire are used at the same time at a narrow site, the area occupied by both the temporary toilet and the luminaire is thus reduced.

A signboard 250 is used for a guide or an indication and is indicated as "TOILET" in this modification. It is possible to recognize far away from the location of the toilet.

When the signboard 250 is attached to the temporary toilet, a pair of engaging pipes 251 are inserted into the insertion holes 230 of the connecting bodies 229. The signboard 250 can be easily placed on the temporary toilet by inserting the engaging pipes 251 into the insertion holes 230. In the attaching operation of the signboard 250, the operator climbs the steps 212 to reach the roofed portion 203 so that the signboard 250 can be fixed.

In a season like summer when the outdoor weather is hot, it is necessary to avoid direct sunshine to prevent the inside of the temporary toilet from becoming hot and stuffy. For this reason, a heat insulating roof cover 245 is formed of, e.g. reinforcing plastics and shaped like a roof which is inclined in four directions. When this roof cover 245 is fixed to the temporary toilet, engaging pipes 246 protruding from the roof cover 245 are inserted into the pipe holes 228 of the connecting pipes 227. The roof cover 245 is spaced a predetermined interval above the roofed portion 203, thereby receiving the direct sunshine so that the roofed portion 203 is shaded. As a result, the temperature inside of the temporary toilet is minimized.

With the arrangement of the temporary toilet according to the second embodiment, the temporary prefabricated structure can be easily loaded on or unloaded from the bed of the truck. Accordingly, the temporary toilet according to this modification is very convenient for moving thereof.

What is claimed is:

1. A prefabricated portable toilet having a raw sewage disposal apparatus contained in a house, said sewage disposal apparatus including a main sewage-receiving stool connected through a first introduction pipe to a drying vessel, and a urinal for receiving urine therein, wherein the improvement comprises a urine storage tank which is separate from said drying vessel and is connected through a second introduction pipe to the urinal, an intermediate connecting means including a connecting pipe connected to said storage tank for supplying urine to the drying vessel for drying thereof, discharge means connected between the storage tank and the main stool for discharging urine from said tank into the main stool to effect cleaning of said stool, means for positively pressurizing the storage tank to cause a flow of urine through the discharge means into the main stool and from which the urine is then supplied to the drying vessel, and means for preventing recirculation to the main stool of any urine that has passed through the main sewage-receiving stool.

2. A portable toilet according to claim 1, wherein the discharge means includes a selectively openable valve means associated therewith for controlling flow therethrough to the main stool.

3. A portable toilet according to claim 2, wherein said pressurizing means includes an air-supply conduit connected to said storage tank and having a control valve associated therewith, and air moving means coupled to said conduit for supplying air therethrough for pressurizing the storage tank.

4. A portable toilet according to claim 1, wherein said connecting means includes an auxiliary urine-storage tank connected to the main storage tank through a first discharge conduit having a first valve associated therewith, and a second discharge conduit connected between said auxiliary storage tank and said first introduction pipe and having a second valve associated therewith.

5. A portable toilet according to claim 4, wherein said first valve is normally maintained in an open position and said first discharge pipe communicates with an upper portion of the main storage tank to permit maintaining of a predetermined volume of urine in the main storage tank with excess urine being permitted to flow through the first discharge pipe into the auxiliary storage tank.

6. A raw sewage disposal apparatus comprising:

a main stool for receiving raw sewage;

heat-resistant vessel means connected to said main stool by a first introduction pipe for receiving a drying raw sewage from said main stool;

a stirring means in said vessel means having a plurality of stirring blades for stirring the raw sewage in the vessel means;

a plurality of heat-holding bodies contained in the vessel means;

a urinal for receiving urine;

a urine storage tank Separate from said vessel means and connected to said urinal by a second introduction pipe for receiving and storing urine from the urinal;

discharge means connected between the urine storage tank and the main stool for discharging urine from said tank into the main stool to effect cleaning of said stool;

means for positively pressurizing the storage tank to cause a flow of urine through the discharge means into the main stool and from which the urine is then supplied to the first introduction pipe and then to the vessel means for drying thereof; and means for preventing recirculation of any urine that has passed through the main stool back to said stool for subsequent main stool cleanings.

7. A raw sewage disposal apparatus according to claim 6 further comprising connecting means connected between said urine storage tank and said vessel means for permitting urine to be discharged into the vessel means while bypassing said main stool.

8. A raw sewage disposal apparatus according to claim 7 wherein said connecting means includes an auxiliary urine storage tank connected to the main urine storage tank through a first discharge conduit having a first valve associated therewith, and a second discharge conduit connected between said auxiliary storage tank and said first introduction pipe and having a second valve associated therewith.

9. A raw sewage disposal apparatus according to claim 8, wherein said first valve is normally maintained in an open position and said first discharge conduit communicates with an upper portion of the main storage tank to permit maintaining of a predetermined volume of urine in the main storage tank with excess urine being permitted to flow through the first discharge conduit into the auxiliary storage tank.

10. A raw sewage disposal apparatus according to claim 9, including sensor means associated with said auxiliary storage tank for detecting the volume of urine stored therein and for emitting a signal which controls opening of the second valve to permit flow of urine through the second discharge pipe into the introduction pipe.

11. A prefabricated toilet comprising a raw sewage disposal apparatus contained in a house, said raw sewage disposal apparatus including:

a main sewage receiving stool;

heat-resistant drying vessel means for receiving and drying all raw sewage and urine received therein so that a liquid component of said raw sewage and said urine is changed to vapor and a solid component of said raw sewage is changed to dry dust;

a urinal:

a urine storage tank separate from said drying vessel;

means connecting said urinal, said storage tank, said vessel means and said stool for preventing recirculation to the main stool of any urine, said recirculation preventing means including (a) a first introduction pipe connecting said stool to said vessel means for supplying raw sewage to said vessel means, said introduction pipe preventing raw sewage from recirculating back to said stool, (b) a second introduction pipe connecting said urinal to said separate urine storage tank for permitting urine to flow from said urinal to said storage tank, (c) an intermediate connecting means connecting said storage tank to said vessel means for permitting unidirectional flow of urine from said storage tank to said vessel means, and (d) discharge means connected between the urine storage tank and the main stool for discharging urine from said tank to the main stool to effect cleaning of said stool; and means for positively pressurizing said storage tank to cause a flow of urine through the discharge means into the stool and from which urine is then supplied through the first introduction pipe to the vessel means.

* * * * *